US008567596B1

(12) United States Patent
Mason, Jr.

(10) Patent No.: US 8,567,596 B1
(45) **Date of Patent: *Oct. 29, 2013**

(54) ELECTRONIC DEVICE PROTECTIVE FILM APPLICATION KIT AND METHOD

(75) Inventor: Andrew C. Mason, Jr., Glendora, CA (US)

(73) Assignee: Zagg Intellectual Property Holding Co., Inc., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/856,223

(22) Filed: Aug. 13, 2010

Related U.S. Application Data

(63) Continuation-in-part of application No. 12/156,879, filed on Jun. 4, 2008, now Pat. No. 7,784,610, which is a continuation-in-part of application No. 11/394,807, filed on Apr. 1, 2006, now Pat. No. 7,389,869.

(51) Int. Cl.

| | |
|---|---|
| ***B65D 71/00*** | (2006.01) |
| ***B65D 73/00*** | (2006.01) |
| ***B44C 1/175*** | (2006.01) |
| ***H01J 29/89*** | (2006.01) |
| ***A46B 11/00*** | (2006.01) |

(52) U.S. Cl.
USPC ..... 206/230; 156/230; 206/461; 206/576; 313/479; 313/512; 401/125; 401/130

(58) Field of Classification Search
USPC ..... 206/229–231, 447, 461, 471, 568, 576, 206/449, 813; 156/230, 236; 313/478, 479, 313/512; 359/580, 590, 609; 401/123, 125, 401/130; 428/40.1; 345/173
See application file for complete search history.

(56) References Cited

U.S. PATENT DOCUMENTS 2,095,437 A * 10/1937 Fox ..... 206/813
2,742,145 A * 4/1956 Blackburn et al. ..... 206/449

(Continued)

FOREIGN PATENT DOCUMENTS

DE 20101039 U1 5/2001
EP 0539099 A2 4/1993

(Continued)

OTHER PUBLICATIONS

Phillip John Chipping "Declaration of Phillip John Chipping" Declaration of Inventorship executed Apr. 27, 2010, filed in U.S. Appl. No. 11/681,665 on May 3, 2010, including Exhibits 1-61:

(Continued)

*Primary Examiner* — Bryon Gehman
(74) *Attorney, Agent, or Firm* — Durham Jones & Pinegar Intellectual Property Law Group

(57) ABSTRACT

A kit holding a film sheet and a miniature squeegee may also include a bottle of an activation solution for an adhesive on the film sheet. The film sheet corresponds in size and shape to a display of an electronic device. Excess solution is removed from the display while evenly distributing the adhesive using wiping motions with the squeegee. In a dry adhesive application, a cover sheet over the adhesive is perforated so that one portion of the cover sheet may be removed for adhering one part of the film sheet to the display, and after securing the one part, the remainder of the cover sheet is removed to adhere the remainder of the film sheet to the display.

18 Claims, 4 Drawing Sheets

(56) References Cited

U.S. PATENT DOCUMENTS

| | | | | |
|---|---|---|---|---|
| 2,906,397 | A * | 9/1959 | Simmons | 206/447 |
| 3,086,647 | A * | 4/1963 | Krezanoski | 206/484 |
| 3,629,034 | A | 12/1971 | Kuroda | |
| 4,151,319 | A | 4/1979 | Sackoff et al. | |
| 4,292,481 | A | 9/1981 | Barnes et al. | |
| 5,132,588 | A | 7/1992 | Warman | |
| RE35,318 | E | 8/1996 | Warman | |
| 5,677,050 | A | 10/1997 | Bilkadi et al. | |
| 5,730,644 | A * | 3/1998 | Pfanstiehl | 206/229 |
| 5,732,414 | A | 3/1998 | Monica | |
| 5,820,957 | A | 10/1998 | Schroeder et al. | |
| 5,922,427 | A * | 7/1999 | King | 206/449 |
| 6,017,079 | A | 1/2000 | Warner | |
| 6,082,535 | A | 7/2000 | Mitchell | |
| 6,129,929 | A | 10/2000 | Wick | |
| 6,142,868 | A * | 11/2000 | Pfanstiehl | 206/229 |
| 6,178,680 | B1 | 1/2001 | Sloot | |
| 6,227,599 | B1 | 5/2001 | Campfield et al. | |
| 6,250,765 | B1 | 6/2001 | Murakami | |
| 6,372,313 | B1 * | 4/2002 | D'Alessio et al. | 206/229 |
| 6,408,132 | B1 | 6/2002 | Ishikawa | |
| 6,491,775 | B1 | 12/2002 | Janssen et al. | |
| 6,526,959 | B1 | 3/2003 | Lee et al. | |
| 6,613,411 | B2 | 9/2003 | Kollaja et al. | |
| 6,614,423 | B1 * | 9/2003 | Wong et al. | 345/173 |
| 6,660,388 | B2 | 12/2003 | Liu | |
| 6,733,863 | B1 | 5/2004 | Mizuno et al. | |
| 6,800,378 | B2 | 10/2004 | Hawa et al. | |
| 6,802,416 | B1 * | 10/2004 | D'Alessio et al. | 206/229 |
| 6,831,714 | B2 | 12/2004 | Masaki et al. | |
| 6,841,190 | B2 | 1/2005 | Liu et al. | |
| 6,878,425 | B1 | 4/2005 | Gomes | |
| 6,914,774 | B1 | 7/2005 | Albertini et al. | |
| 6,960,040 | B2 * | 11/2005 | D'Alessio et al. | 206/205 |
| 6,975,888 | B2 | 12/2005 | Buesseler et al. | |
| 7,016,008 | B2 * | 3/2006 | Jung et al. | 349/153 |
| 7,351,470 | B2 | 4/2008 | Draheim et al. | |
| 7,389,869 | B2 | 6/2008 | Mason, Jr. | |
| 7,529,364 | B2 | 5/2009 | Buehler | |
| 7,558,594 | B2 | 7/2009 | Wilson | |
| 7,729,493 | B2 | 6/2010 | Krieger et al. | |
| 7,781,610 | B2 | 8/2010 | Schneider et al. | |
| 7,784,610 | B2 | 8/2010 | Mason | |
| D623,180 | S | 9/2010 | Diebel | |
| D623,638 | S | 9/2010 | Richardson et al. | |
| D623,639 | S | 9/2010 | Richardson et al. | |
| D624,910 | S | 10/2010 | Richardson et al. | |
| D632,686 | S | 2/2011 | Magness et al. | |
| 7,912,520 | B2 | 3/2011 | Choi et al. | |
| D638,412 | S | 5/2011 | Lee | |
| D638,414 | S | 5/2011 | Magness et al. | |
| D639,286 | S | 6/2011 | Mohoney | |
| 7,957,524 | B2 | 6/2011 | Chipping | |
| D641,348 | S | 7/2011 | Kim et al. | |
| D644,218 | S | 8/2011 | Akana et al. | |
| 7,991,440 | B2 | 8/2011 | Liu et al. | |
| D647,519 | S | 10/2011 | Rothbaum et al. | |
| 2002/0114934 | A1 | 8/2002 | Liu | |
| 2004/0170817 | A1 | 9/2004 | Fox et al. | |
| 2004/0246386 | A1 | 12/2004 | Thomas | |
| 2005/0022924 | A1 * | 2/2005 | Blackburn | 156/230 |
| 2005/0047589 | A1 | 3/2005 | Chang | |
| 2005/0116334 | A1 | 6/2005 | Buehler | |
| 2005/0168697 | A1 | 8/2005 | Bruzzone et al. | |
| 2006/0040081 | A1 | 2/2006 | Hodsdon et al. | |
| 2006/0186001 | A1 | 8/2006 | Anderson et al. | |
| 2006/0222801 | A1 | 10/2006 | Mase | |
| 2007/0026234 | A1 | 2/2007 | Mase | |
| 2007/0229962 | A1 | 10/2007 | Mason, Jr. | |
| 2008/0099152 | A1 | 5/2008 | Nakamura | |
| 2008/0196804 | A1 | 8/2008 | Hsu | |
| 2009/0009945 | A1 | 1/2009 | Johnson et al. | |
| 2009/0050499 | A1 | 2/2009 | Calco et al. | |
| 2009/0186181 | A1 | 7/2009 | Mase | |
| 2009/0301907 | A1 | 12/2009 | Mason | |
| 2009/0325657 | A1 | 12/2009 | Ramsdell et al. | |
| 2010/0270189 | A1 | 10/2010 | Pedersen, II et al. | |
| 2011/0267793 | A1 | 11/2011 | Cohen et al. | |

FOREIGN PATENT DOCUMENTS

| | | | |
|---|---|---|---|
| EP | 1 557 452 | A1 | 7/2005 |
| KR | 20-2000-0013715 | | 12/2000 |
| WO | 03/036454 | A1 | 5/2003 |
| WO | 2007/046637 | A1 | 4/2007 |

OTHER PUBLICATIONS

U.S. Appl. No. 11/681,665, Exhibit 1: File listing from Chipping's home computer showing Feb. 24, 2005, creation date of Adobe Photoshop file "before_after_small".

U.S. Appl. No. 11/681,665, Exhibit 2: Image of "before_after_small" file.

U.S. Appl. No. 11/681,665, Exhibit 3: File listing from Chipping's home computer showing Mar. 28, 2005, creation date of Adobe Illustrator file "the_shield_ai".

U.S. Appl. No. 11/681,665, Exhibit 4: Image of "the_shield_ai" file showing Chippings business card designs.

U.S. Appl. No. 11/681,665, Exhibit 5: Zoomed-in image of bottom left portion of "the_shield_ai" file.

U.S. Appl. No. 11/681,665, Exhibit 6: File listing from chipping's home computer showing Mar. 28, 2005, creation date of Adobe Illustrator file "business cards to print for retail—single.ai".

U.S. Appl. No. 11/681,665, Exhibit 7: Image of "business cards to print for retail—single.ai" file.

U.S. Appl. No. 11/681,665, Exhibit 8: File Listing from Chipping's home computer showing April 14, 2005, creation dated of business website "aboutfilm.html".

U.S. Appl. No. 11/681,665, Exhibit 9: Image of "aboutfilm.html" file.

U.S. Appl. No. 11/681,665, Exhibit 10: File listing from Chipping's home comoputer showing various .gif and .html computer files with creation dates in Apr. 2005.

U.S. Appl. No. 11/681,665, Exhibit 11: Chipping's Excel spreadsheet used to record transactions from website beginning Apr. 22, 2005.

U.S. Appl. No. 11/681,665, Exhibit 12: File listing from Chipping's home computer showing May 6, 2005, creation date of sales website "ipod2.html".

U.S. Appl. No. 11/681,665, Exhibit 13: Image of "ipod2.html" file.

U.S. Appl. No. 11/681,665, Exhibit 14: Image of Internet Archive "www.archive.org/web/web.php".

U.S. Appl. No. 11/681,665, Exhibit 15: Image from Internet Archive showing "http://www.we-got-you-covered.com" as of May 9, 2005.

U.S. Appl. No. 11/681,665, Exhibit 16: Image of home page for "http://www.we-got-you-covered.com" as it was archived by Internet Archive as of May 9, 2005.

U.S. Appl. No. 11/681,665, Exhibit 17: File listing from Chipping's home computer showing May 9, 2005, creation date of website "index.html".

U.S. Appl. No. 11/681,665, Exhibit 18: Image of "index.html" file.

U.S. Appl. No. 11/681,665, Exhibit 19: Image of "ipod screens"link from home page for "http://www.we-got-you-covered.com" as it was archived by Internet Archive as of May 9, 2005.

U.S. Appl. No. 11/681,665, Exhibit 20: File listing from Chipping's home computer showing May 6, 2005, creation date of Adobe Illustrator file "ipod mini full-body shield.ai".

U.S. Appl. No. 11/681,665, Exhibit 21: Image of "ipod mini full-body shield.ai" file.

U.S. Appl. No. 11/681,665, Exhibit 22: File listing from Chipping's home computer showing May 10, 2005, creation date of Adobe Illustrator file "iPod reg full-body shield 2.ai".

U.S. Appl. No. 11/681,665, Exhibit 23: Image of "iPod reg full-body shield 2.ai" file.

U.S. Appl. No. 11/681,665, Exhibit 24: File listing from Chipping's home computer showing May 14, 2005, creation date of Adobe Illustrator file "shield—iPod reg (full-body).ai".

U.S. Appl. No. 11/681,665, Exhibit 25: Image of "shield—iPod reg (full-body).ai" file.

(56) References Cited

OTHER PUBLICATIONS

U.S. Appl. No. 11/681,665, Exhibit 26: File listing from Chipping's home computer showing Jul. 1, 2005, creation date of Adobe Illustrator file "shield—iPod reg 40 & 60 gig (full-body).ai".
U.S. Appl. No. 11/681,665, Exhibit 27: Image of "shield—iPod reg 40 & 60 gig (full-body).ai" file.
U.S. Appl. No. 11/681,665, Exhibit 28: File listing from Chipping's home computer showing Jun. 2, 2005, creation date of Adobe Illustrator file "iPod—20 & 30 GB—full body—pic explanation.ai".
U.S. Appl. No. 11/681,665, Exhibit 29: Image of "iPod—20 & 30 GB—full body—pic explanation.ai" file.
U.S. Appl. No. 11/681,665, Exhibit 30: File listing from Chipping's home computer showing Jul. 22, 2005, creation date of file "product-picture.gif".
U.S. Appl. No. 11/681,665, Exhibit 31: Image of "product-picture.gif" file.
U.S. Appl. No. 11/681,665, Exhibit 32: File listing from Chipping's home computer showing Jun. 2, 2005, creation date of Adobe Illustrator file "header card—ipod—to print.ai".
U.S. Appl. No. 11/681,665, Exhibit 33: Image of "header card—ipod—to print.ai" file.
U.S. Appl. No. 11/681,665, Exhibit 34: Image showing the existence of "http://www.theinvisibleshield.com" in Internet Archive's records as it existed on Jul. 2, 2005.
U.S. Appl. No. 11/681,665, Exhibit 35: Image showing Internet Archive record of "http://www.theinvisibleshield.com" website on Jul. 2, 2005.
U.S. Appl. No. 11/681,665, Exhibit 36: Image of "http://www.theinvisibleshield.com" home page as archived Jul. 2, 2005 by Internet archive.
U.S. Appl. No. 11/681,665, Exhibit 37: Jul. 7, 2005 Press Release listing exhibitors, issued by McWorld Conference & Expo held Jul. 11-14, 2005 at the Hynes Convention Center in Boston, Massachusetts, United States.
U.S. Appl. No. 11/681,665, Exhibit 38: The Mac Observer, photograph taken at MacWorld Conference & Expo, posted at "http://www.macobserver.com/gallery_albums.MWBOS2005DAY1/DSCN5106.jpg".
U.S. Appl. No. 11/681,665, Exhibit 39: Blog by Rainy Day posted Jul. 13. 2005 at "http://www.rainydaymagazine.com/RDM2005/RDMHomeJuly2005.htm".
U.S. Appl. No. 11/681,665, Exhibit 40: File listing from Chipping's home computer showing Jul. 21, 2005, creation date of file "scratchedipod-big.gif".
U.S. Appl. No. 11/681,665, Exhibit 41: Image of "scratchedipod-big.gif" file.
U.S. Appl. No. 11/681,665, Exhibit 42: John G. Spooner "The iPod's Economy Is Booming" PCMAG.COM posted online at www.pcmag.com on Jul. 13, 2005.
U.S. Appl. No. 11/681,665, Exhibit 43: Dan Frakes on behalf of Playlist Magazine "Macworld Expo Boston from an iPod's point of view" posted online at www.macworld.com on Jul. 15, 2005 http:///www.macworld.com/article/45891/2005/07/2005bostoneproipod.htm.
U.S. Appl. No. 11/681,665, Exhibit 44: Chuck Joiner "Roving Reporter: Notes from Macworld Boston" posted online at www.macsimumnews.com on Jul. 23, 2005.
U.S. Appl. No. 11/681,665, Exhibit 45: Garrett Harding Blog posting at "Harding's BLOG"on Aug. 19, 2005.
U.S. Appl. No. 11/681,665, Exhibit 46: The MUG Center: The Mac User Group Resource Site "The User Group Report: Day 2 at Macworld Expo: Initial Show Floor Walk-Through, Invisible Shield, Old Friends and Two Berklee Students from Libe" posted online on Jul. 13, 2005 at http://www.mugcenter.com/usergroupreport/2005/MWBoston2.html.
U.S. Appl. No. 11/681,665, Exhibit 47: Transcript of interview of Chipping by Chuck Joiner at Macworld Boston 2005 publicly available Jul. 13, 2005. Archived recording of interview available online at http://www.usergroupreport.com /MP3/2005/UGRMWBoston052.mp3 .
U.S. Appl. No. 11/681,665, Exhibit 48: Louis DiCarro posting on www.macradio.com on Jul. 13, 2005 referencing interviewwith Chipping.
U.S. Appl. No. 11/681,665, EXhibit 49: Jul. 8, 2005, posting at www.prweb.com stating an archived recording of DiCarro interview of Chipping available online at http://media.macradio.com/mp3s/mwbh05_1312.mp3.
U.S. Appl. No. 11/681,665, Exhibit 50: Transcript of Dicarro's interview of Chipping. Archived recording of interview available at http://media.macradio.com/mp3s/mwbh05_1312.mp3.
U.S. Appl. No. 11/681,665, Exhibit 51: Wan Chi Lau "Gear & Gadgets . . . " Rainy Day Magazines published online in portions on Sep. 18, 22 and 27, 2005 at http://www.rainydaymagazine.com/RDM2005/GearNGadgets/September2005/RDMGG_InvisibleShieldFirstLook.htm.
U.S. Appl. No. 11/681,665, Exhibit 52: Images from www.rainydaymagazine.com showing Sep. 2005 posting dates of "Gear & Gadgets".
U.S. Appl. No. 11/681,665, Exhibit 53: Ilene Hoffman review of Invisible Shield published online Nov. 18, 2005 at www.macnn.com available at http://www.macnn.com/reviews/invisibleshield-for-ipod.html.
U.S. Appl. No. 11/681,665, Exhibite 54: Jim Rossman "Accessorize the iPod" The Dallas Morning News Nov. 26, 2005 available online at http://www.dallasnews.com/sharedcontent/ptech/generalstories2/112605ccdrptechtechipod.295febe7.html.
U.S. Appl. No. 11/681,665, Exhibit 55: B.J. Abernaethy "iPod Garage Nanobook" Holiday 2005 edition.
U.S. Appl. No. 11/681,665, Exhibit 56: Product review testimonial by various users posted online Apr. 28, 2006 at http://web.archive.org/web/20060428090923/www.shieldzone.com/testimony/index.html.
U.S. Appl. No. 11/681,665, Exhibit 57: Press release by Protective Solutions, Inc. "First Invisible Scratch Protector/Case for New Apple iPod nano Available from Protective Solutions" published online by www.businesswire.com on Sep. 21, 2005.
U.S. Appl. No. 11/681,665, Exhibit 58: Brice Wallace "Firm seeks a scratch-free world" Deseret News published Dec. 19, 2005.
U.S. Appl. No. 11/681,665, Exhibit 59: Press release issued by ZAGG Incorporated "ZAGG Reports Third Quarter Financial Results Revenue Increased 76% Year over Year" published online by www.businesswire.com on Nov. 14, 2007.
U.S. Appl. No. 11/681,665, Exhibit 60: Image from www.bestskinsever.com in Oct. 2005.
U.S. Appl. No. 11/681,665, Exhibit 61: Image from www.bodygaurdz.com in Jan. 2007.
3M "Scotchal™ Translucent Graphic Film" Product Bulletin 8628 Release date Sep. 2009.
3M "Scotchal™ High Performance Striping and Graphics: Application, Maintenance and Removal for Professional Applicators—Instruction Bulletin 2-13" Feb. 2000.
Protective Solutions, Inc. "We Got You Covered" website www.we-got-you-covered.com available at http://web.archive.org/web/20050509134536/http://www.we-got-you-covered.com/, archived May 2005 (last visited Jun. 11, 2012).
Protective Solutions, Inc. "We Got You Covered" website www.we-got- you-covered.com available at http://web.archive.org/web/20050509162817/http://www.we-got-you-covered.com/ipod.html, archived May 2005 (last visited Jun. 11, 2012).
Protective Solutions, Inc. "We Got You Covered" website www.we-got- you-covered.com/ipod available at http://web.archive.org/web/20050509163117/http://www.we-got-you-covered.com/aboutfilm.html, archived May 2005 (last visited Jun. 11, 2012).
Protective Solutions, Inc. "We Got You Covered" website www.we-got- you-covered.com/aboutfilm available at http://web.archive.org/web/20050702012158/http://www.theinvisibleshield.com/, archived May 2005 (last visited Jun. 11, 2012).
Protective Solutions, Inc. "We Got You Covered" website www.theinvisibleshield.com available at http://web.archive.org/web/20050721234906/http://www.theinvisibleshield.com/aboutfilm.html, archived Jul. 2005 (last visited Jun. 11, 2012).
Protective Solutions, Inc. "We Got You Covered" website www.theinvisibleshield.com/ipod available at http://web.archive.org/web/

(56) References Cited

OTHER PUBLICATIONS

20050722000053/http://www.theinvisibleshield.com/ipod.html, archived Jul. 2005 (last visited Jun. 11, 2012).
invisibleSHIELD "The ULTIMATE screen protector" website www.theinvisibleshield.com/application available at http://web.archive.org/web/20051022000539/http://www.theinvisibleshield.com/application.html, archived Oct. 2005 (last visited Jun. 11, 2012).
invisibleSHIELD "About Screen Protector Film" website www.theinvisibleshield.com/index.asp?PageAction . . . available at http://web.archive.org/web/20051218204154/http://www.theinvisibleshield.com/index.asp?PageAction=Cust om&ID=14, archived Dec. 2005 (last visited Jun. 11, 2012), archived May 2005 (last visited Jun. 11, 2012).
invisibleSHIELD "Application" website www.theinvisibleshield.com/index.asp?PageAction=Custom&ID=6 available at http://web.archive.org/web/20060203164234/http://www.theinvisibleshield.com/index.asp?PageAction=Custom&ID=6, archived Feb. 2006 (last visited Jun. 11, 2012).
ShieldZone Corporation "Home of the iPod Screen Protector: FAQ" website www.shieldzone.com/faq/index , available at http://web.archive.org/web/20060424023714/http://www.shieldzone.com/faq/index.htmlarchived Apr. 2006 (last visited Jun. 11, 2012).
ShieldZone Corporation "Home of the iPod Screen Protector: Application instructions" website www.shieldzone.com/app_instructions/index available at http://web.archive.org/web/20060424023757/http://www.shieldzone.com/app_instructions/index.html, archived Apr. 2006 (last visited Jun. 11, 2012).
ShieldZone Corporation "Home of the iPod Screen Protector" website www.shieldzone.com/store/index available at http://web.archive.org/web/20060428033759/http://www.shieldzone.com/store/index.html, archived Apr. 2006 (last visited Jun. 11, 2012).
ShieldZone Corporation "Home of the iPod Screen Protector: FAQ" website www.shieldzone.com/faq/index available at http://web.archive.org/web/20060502022439/http://www.shieldzone.com/faq/index.html, archived May 2006 (last visited Jun. 11, 2012).
ShieldZone Corporation "Home of the iPod Screen Protector: About ShieldZone" website www.shieldzone.com/company/aboutus available at http://web.archive.org/web/20060502022620/http://www.shieldzone.com/company/aboutus.html, archived May 2006 (last visited Jun. 11, 2012).
ShieldZone Corporation "Home of the iPod Screen Protector: Application instructions" website www.shieldzone.com/app_instructions/index available at http://web.archive.org/web/20060504050048/http://www.shieldzone.com/app_instructions/index.html, archived May 2006 (last visited Jun. 11, 2012).
ShieldZone Corporation "Home of the iPod Screen Protector: Application instructions" website www.shieldzone.com/app_instructions/index available at http://web.archive.org/web/20060705100135/http://www.shieldzone.com/app_instructions/index.html, archived Jul. 2006 (last visited Jun. 11, 2012).
ShieldZone Corporation "Home of the iPod Screen Protector: Application instructions" website www.shieldzone.com/app_instructions/index available at http://web.archive.org/web/20060717181400/http://www.shieldzone.com/app_instructions/index.html, archived Jul. 2006 (last visited Jun. 11, 2012).
ShieldZone Corporation "Home of the iPod Screen Protector: Application instructions" website www.shieldzone.com/app_instructions/index available at http://web.archive.org/web/20060909002223/http://www.shieldzone.com/app_instructions/index.html, archived Sep. 2006 (last visited Jun. 11, 2012).
Tocken Wrapper, Protetive film for iPod Shuffle; www.tocken.co.kr; 2004-2005.
3M "Polyurethane Protective Tape: Preparation and Application Instructions" Technical Bulletin Oct. 2001.
Auto Paint Guard Automobile Clear Bra—Protecting Your Investment website archived at http://web.archive.org/web/20050728232723/http://www.autopaintguard.com/installation.html Jul. 2005.
Tocken Wrapper for iPod mini; http://caizer.com/?mid__tech&page=22&document__sr1=20234&listStyle=&page=; Feb. 18, 2005.
http://www.enfun.net/technique/review/?step=20&dataSeqNo=42417; Jan. 13, 2005.
Statement by Min-Woo SEO of Samsung Electronics Co., Ltd., Mar. 10, 2010.
http://www.appleforum.com; AppleForum; Jul.-Nov. 2005.
WITHIPOD Community for Korean Ipod Users; http://withipod.net/?mid=podmagazine__notice&category=2078464&search__keyboard=tocken&search__target =title&document__sr1=2078532; Nov. 22, 2004.
Tocken Wrapper, User's Review: WITHIPOD Community for Korean Ipod Users; http://www.withipod.net/bbs/zboard/php?id=community__ipod__gallery&no=1224; Mar. 24, 2005.
Tocken Wrapper, User's Review: WITHIPOD Community for Korean Ipod Users; http://www.withipod.net/bbs/zboard/php?id=community__ipod__gallery&no=1188; Mar. 21, 2005.
MacMadang "I hate the Same thing though it is pretty!:TOCKEN Wrapper" Magazine vol. 162 Jul. 1, 2005.
Users review of Noxk PSP protection film from internet website; http://raven.egloos.com/1076693; Jul. 25, 2005.
Tocken Wrapper sales bulletin published at http://kmug.co.kr; Sep. 11, 2005.
Crandall/Dahl/Lardner "An Introduction to the Mechanics of Solids" Jan. 25, 1996; pp. 273-276.
Case No. 2008 Dang 3751 and 2009 Dang 1523; Presentation for Oral Hearing for Invalidation and Scope Confirmation Trial of Registered Patent No. 784501; Kim & Chang Mar. 16, 2010.
Case No. 2008 Dang 3751 and 2009 Dang 1523; Seung-Kyun Oh (president of Korean distributor for ZAGG); Brief for Invalidation and Scope Confirmation Trial of Registered Patent No. 784501; Sep. 18, 2009; English translation only.
Case No. 2008 Dang 3751 and 2009 Dang 1523; Seung-Kyun Oh (president of Korean distributor for ZAGG); Brief for Invalidation and Scope Confirmation Trial of Registered Patent No. 784501; Oct. 14, 2009.
Case No. 2008 Dang 3751 and 2009 Dang 1523; SGP Brief for Invalidation and Scope Confirmation Trial of Registered Patent No. 784501; Oct. 14, 2009.
Case No. 2008 Dang 3751 and 2009 Dang 1523; Seung-Kyun Oh (president of Korean distributor for ZAGG); Brief for Invalidation and Scope Confirmation Trial of Registered Patent No. 784501; Nov. 14, 2009.
iPodlounge "Buyer's Guide 2004" Issue 01, Nov. 2004.
United States District Court, Central District of California; Case No. CV 10-6511 (FFMx) Defendant NLU Products, L.L.C.'s Objections and Responses to Plaintiff's First Set of Interrogatories to Defendants; Apr. 18, 2011.
United States District Court, Central District of California; Case No. CV 10-6511 (FFMx) Wrapsol LLC's Responses to Plaintiff's First Set of Interrogatories; May 2, 2011.
United States District Court, Central District of California; Case No. CV 10- 6511 (FFMx) Plaintiff's Responses and Objections to Wrapsol LL:C's First Set of Interrogatories; May 12, 2011.
United States District Court, Central District of California; Case No. CV 10-6511 (FFMx) Wrapsol LLC's First Supplemental Responses to Plaintiff's First Set of Interrogatories (Interrogatories 2 & 3); Sep. 12, 2011.
United States District Court, Central District of California; Case No. CV 10-6511 (FFMx) Plaintiff's First Supplemental Responses to Defendant Wrapsol LLC's First Set of Interrogatories (Interrogatories 6, 7, 19); Sep. 29, 2011.
United States District Court, Central District of California; Case No. CV 10-6511 (FFMx) NLU Products, L.L.C.'s First Set of Interrogatories to ZAGG Intellectual Holding Co., Inc.; Feb. 3, 2012.
United States District Court, Central District of California; Case No. CV 10-6511 (FFMx) NLU Products, L.L.C.'s First Set of Requests for Admission to ZAGG Intellectual Holding Co., Inc.; Feb. 3, 2012.
United States District Court, Central District of California; Case No. CV 10-6511 (FFMx) Wrapsol LLC's Responses to Plaintiff's Second Set of Interrogatories; Mar. 5, 2012.

(56) References Cited

OTHER PUBLICATIONS

United States District Court, Central District of California; Case No. CV 10-6511 (FFMx) Plaintiff's Second Supplemental Responses and Objections to Defendant Wrapsol LLC's First Set of Interrogatories; Apr. 18, 2012.
United States District Court, Central District of California; Case No. CV 10-6511 (FFMx) Plaintiff's Third Supplemental Responses and Objections to Defendant Wrapsol LLC's First Set of Interrogatories; Apr. 20, 2012.
United States District Court, Central District of California; Case No. CV 10-6511 (FFMx) Wrapsol LLC's Second Supplemental Responses to Plaintiff's First Set of Interrogatories (Interrogatories 6, 7, 9, 10, 11) Apr. 2, 2012—redacted pursuant to protective order.
International Searching Authority, U.S. Patent & Trademark Office "International Search Report and Written Opinion" Mailed Jan. 11, 2012, in PCT application No. PCT/US2011/041525.
BODYGUARDZ product images with application instructions, sold by NLU Products, LLC, packaging copyright 2007.
U.S. District Court for the Central District of California, Case No. CV10-6511-AHM (FFMx) "Complaint for Patent Infringement of U.S. Patent No. 7,389,869 and U.S. Patent No. 7,784,610 and Demand for Jury Trial", Aug. 31, 2010.
U.S. District Court for the Central District of California, Case No. CV10-6511-AHM (FFMx) "Memorandum of Points and Authorities in Support of Defendant ZAGG, Inc.'s Notice of Motion and Motion to Stay Pending Decision from the Utah District Court on Jurisdictional Issues" Oct. 26, 2010.
U.S. District Court for the Central District of California, Case No. CV10-6511-AHM(FFMx) "Declaration of David W. Tufts in Support of Defendant ZAGG Inc.'s Motion to Stay Pending Decision From the Utah District Court on Jurisdictional Issues" Oct. 26, 2010.
U.S. District Court for the Central District of California, Case No. CV10-6511-AHM (FFMx) "Amended Complaint for Patent Infringement of U.S. Patent No. 7,784,610 and Jury Demand I", Dec. 23, 2010.
U.S. District Court for the Central District of California, Case No. CV10-6511-AHM (FFMx) "Defendant NLU Products, L.L.C.'s Answer and Counterclaims" Feb. 4, 2011.
U.S. District Court for the Central District of California, Case No. CV10-6511-AHM (FFMx) "Wrapsol LLC's Answer, Affirmative Defenses, and Jury Demand to Plaintiff's Amended Complaint" Feb. 4, 2011.
U.S. District Court for the Central District of California, Case No. CV10-6511-AHM (FFMx) "Defendant NLU Products, L.L.C.'s Answer and Counterclaims" to Plaintiff's Amended Complaint, Mar. 3, 2011.
U.S. District Court for the Central District of California, Case No. CV10-6511-AHM (FFMx) "Wrapsol LLC's Answer, Affirmative Defenses, and Jury Demand to Plaintiff's Amended Complaint" Mar. 14, 2011.
U.S. District Court for the Central District of California, Case No. CV10-6511-AHM (FFMx) "Parties' Joint Rule 16(b) Report" Mar. 28, 2011.
U.S. District Court for the Central District of California, Case No. CV10-6511-AHM (FFMx) "Plaintiffs Notice of Motion and Motion to Dismiss NLU's Inequitable Conduct Counterclaims and Affirmative Defense Pursuant to Fed. R. Civ. P. 12(b)(6) and 9(b); Memorandum of Points and Authorities in Support Thereof" Mar. 28, 2011.
U.S. District Court for the Central District of California, Case No. CV10-6511-AHM (FFMx) Plaintiff's Notice of Motion and Motion to Dismiss Wrapsol's Inequitable Conduct Counterclaim and Affirmative Defense Pursuant to Fed. R. Civ. P. 12(b)(6) and 9(b); Memorandum of Points and Authorities in Support Thereof' Apr. 7, 2011.
U.S. District Court for the Central District of California, Case No. CV10-6511-AHM (FFMx) "Declaration of Melissa R. Badgett in Support of Defendants' Opposition to Plaintiff's Motion to Dismiss NLU's and Wrapsol's Inequitable Conduct Counterclaim and Affirmative Defenses" Apr. 25, 2011.
U.S. District Court for the Central District of California, Case No. CV10-6511-AHM (FFMx) "Defendants' Joint Opposition to Plaintiff's Motion to Dismiss NLU's and Wrapsol's Inequitable Conduct Counterclaim and Affirmative Defenses" Apr. 25, 2011.
U.S, District Court for the Central District of California, Case No. CV10-6511-AHM (FFMx) "Plaintiff's Reply in Support of its Motion to Dismiss Defendants' Inequitable Conduct Counterclaims and Affirmative Defense Pursuant to Fed. R. Civ. P. 12(b)(6) and 9(b)" May 2, 2011.
U.S. District Court for the Central District of California, Case No. CV10-6511-AHM (FFMx) "Plaintiffs Notice of Errata in its Reply in Support of its Motion to Dismiss Defendants' Inequitable Conduct Counterclaims and Affirmative Defense Pursuant to Fed. R. Civ. P. 12(b)(6) and 9(b)" May 5, 2011.
U.S. District Court for the Central District of California, Case No. CV10-6511-AHM (FFMx) "Declaration of Kirk Feller in Support of Defendant NLU Products, L.L.C.'s Motion for Summary Judgment" May 16, 2011.
U.S. District Court for the Central District of California, Case No. CV10-6511-AHM (FFMx) "Defendant NLU Products, L.L.C.'s Notice of Motion for Summary Judgment; Memorandum of Points and Authorities [Statement of Uncontroverted Facts and Conclusions of Law and Declaration of Kirk Feller Filed Concurrently Herewith]" May 16, 2011.
U.S. District Court for the Central District of California, Case No. CV10-6511-AHM (FFMx) "Statement of Uncontroverted Facts and Conclusions of Law in Support of Defendant NLU Products, L.L.C.'s Motion for Summary Judgment" May 16, 2011.
U.S. District Court for the Central District of California, Case No. CV10-6511-AHM (FFMx) "Declaration of Jonathan B. Benson in Opposition to Defendant NLU Products, L.L.C.'s Motion for Summary Judgment" May 31, 2011.
U.S. District Court for the Central District of California, Case No. CV10-6511-AHM (FFMx) "Plaintiff's Opposition to Defendant NLU Products, L.L.C.'s Motion for Summary Judgment" May 31, 2011.
U.S. District Court for the Central District of California, Case No. CV10-6511-AHM (FFMx) "Plaintiffs Statement of Genuine Disputes in Opposition to Defendant NLU Products, L.L.C.'s Motion for Summary Judgment" May 31, 2011.
U.S. District Court for the Central District of California, Case No. CV10-6511-AHM (FFMx) "Declaration of David W. Tufts in Opposition to Defendant NLU Products, L.L.C.'s Motion for Summary Judgment and Pursuant to General Order No. 06-07" May 31, 2011.
U.S. District Court for the Central District of California, Case No. CV10-6511-AHM (FFMx) "Defendant NLU Products, L.L.C.'s Reply in Support of Motion for Summary Judgment" Jun. 13, 2011.
U.S. District Court for the Central District of California, Case No. CV10-6511-AHM (FFMx) "Civil Minutes—General" Jul. 6, 2011.
U.S. District Court for the Central District of California, Case No. CV10-6511-AHM (FFMx) "Affidavit of Lewis Cohen" Nov. 7, 2011.
U.S. District Court for the Central District of California, Case No. CV10-6511-AHM (FFMx) "Declaration of Melissa R. Badgett in Support of Wrapsol, L.L.C.'s Opening Claim Construction Brief" Nov. 7, 2011.
U.S. District Court for the Central District of California, Case No. CV10-6511-AHM (FFMx) "Declaration of Clinton E. Duke in Support of Plaintiff's Claim Construction Brief" Nov. 7, 2011.
U.S. District Court for the Central District of California, Case No. CV10-6511-AHM (FFMx) "Declaration of Jonathan B. Benson in Support of Plaintiff's Claim Construction Brief" Nov. 7, 2011.
U.S. District Court for the Central District of California, Case No. CV10-6511-AHM (FFMx) "Identification of Patent Claim Phrases for U.S. Patent No. 7,784,610" Nov. 7, 2011.
U.S. District Court for the Central District of California, Case No. CV10-6511-AHM (FFMx) "Joint Statement of Disputed and Undisputed Terms" Nov. 7, 2011.
U.S. District Court for the Central District of California, Case No. CV10-6511-AHM (FFMx) "Defendant NLU Products, L.L.C's Brief in Support of its Proposed Claim Construction" Nov. 7, 2011.
U.S. District Court for the Central District of California, Case No. CV10-6511-AHM (FFMx) "Plaintiffs Claim Construction Brief" Nov. 7, 2011.

(56) References Cited

OTHER PUBLICATIONS

U.S. District Court for the Central District of California, Case No. CV10-6511-AHM (FFMx) "Wrapsol, LLC's Opening Claim Construction Brief" Nov. 7, 2011.
U.S. District Court for the Central District of California, Case No. CV10-6511-AHM (FFMx) "Affidavit of Lewis Cohen" Nov. 8, 2011.
U.S. District Court for the Central District of California, Case No. CV10-6511-AHM (FFMx) "Declaration of Melissa R. Badgett in Support of Wraposl, L.L.C.'s Rebuttal Claim construction Brief" No. 21, 2011.
U.S. District Court for the Central District of California, Case No. CV10-6511-AHM (FFMx) "Defendant NLU Products, L.L.C.'s Brief in Response to Plaintiff's Claim Construction Brief" Nov. 21, 2011.
U.S. District Court for the Central District of California, Case No. CV10-6511-AHM (FFMx) "Plaintiff's Claim Construction Reply Brief" Nov. 21, 2011.
U.S. District Court for the Central District of California, Case No. CV10-6511-AHM (FFMx) "Second Declaration of Clinton E. Duke in Support of Plaintiffs Claim Construction Brief" Nov. 21, 2011.
U.S. District Court for the Central District of California, Case No. CV10-6511-AHM (FFMx) "Wrapsol, LLC's Rebuttal Claim Construction Brief" Nov. 21, 2011.
U.S. District Court for the Central District of California, Case No. CV10-6511-AHM (FFMx) "Civil Minutes—General" Jan. 17, 2012.
U.S. District Court for the Central District of California, Case No. CV10-6511-AHM (FFMx) "ZAGG Intellectual Property Holding Co., Inc.'s Answer to Defendant NLU Products, L.L.C.'s Counterclaims" Jan. 31, 2012.
U.S. District Court for the Central District of California, Case No. CV10-6511-AHM (FFMx) "ZAGG Intellectual Property Holding Co., Inc.'s Answer to Defendant, Wrapsol LLC's Counterclaims" Jan. 31, 2012.
U.S. District Court for the Central District of California, Case No. CV10-6511-AHM (FFMx) "Defendant Wrapsol, LLC's Motion for Leave to Supplement the Record Regarding Claim Construction" May 18, 2012.
U.S. District Court for the Central District of California, Case No. CV10-6511-AHM (FFMx) "ZAGG Intellectual Property Holding Co., Inc.'s Application for an ex Parte Order Excluding Wrapsol, L.L.C.'S Proposed Witness from Testifying at the Jun. 8, 2012, Markman Hearing" May 31, 2012.
U.S. District Court for the Central District of California, Case No. CV10-6511-AHM (FFMxy)"ZAGG Intellectual Property Holding Co., Inc.'s Memorandum in Opposition to Wrapsol, L.L.C.'s Motion for Leave to Supplement the Claim Construction Record" May 25, 2012.
U.S. District Court, District of Utah, Central Division, Case No. 2:10cv01257-TC-BCW Plaintiff's Responses to Defendant United SGP Corp.'s First Set of Interrogatories (Nos. 1-11) Apr. 9, 2012.
U.S. District Court, District of Utah, Central Division, Case No. 2:10cv00882 "Complaint for Declaratory Judgment" Sep. 4, 2010.
U.S. District Court, District of Utah, Central Division, Case No. 2:10cv00882 "First Amended Complaint" Sep. 7, 2010.
U.S. District Court, District of Utah, Central Division, Case No. 2:10cv00882 "Declaration of Brandon O'Brien" Sep. 23, 2010.
U.S. District Court, District of Utah, Central Division, Case No. 2:10cv00882 "Declaration of Phillip John Chipping" Sep. 23, 2010.
U.S. District Court, District of Utah, Central Division, Case No. 2:10cv00882 "Memorandum in Support of Partial Summary Judgment Regarding Defendants' Liability for Trademark Infringement" Sep. 23, 2010.
U.S. District Court, District of Utah, Central Division, Case No. 2:10-cv-01257-DN "Complaint" Dec. 20, 2010.
U.S. District Court, District of Utah, Central Division, Case No. 2:10-cv-01257-DN "Defendant United SGP Corp.'s Answer to Complaint and Counterclaim; Demand for Jury Trial" Feb. 4, 2011.
U.S. District Court, District of Utah, Central Division, Case No. 2:10-cv-01257-Dn "Defendants XO Skins LLC, Fusion of Ideas, and Ghost Armor LLC's Answer to Complaint and Counterclaim; Demand for Jury Trial" Feb. 14, 2011.
U.S. District Court, District of Utah, Central Division, Case No. 2:10-cv-01257-DN "Memorandum of Points and Authorities in Support of Plaintiffs Motion to Dismiss SGP Corp.'s Inequitable Conduct Counterclaim and Affirmative Defense Pursuant to Fed. R. Civ. P. 12(b) and 9(b)" Mar. 28, 2011.
U.S. District Court, District of Utah, Central Division, Case No. 2:10-cv-01257-DN Memorandum of Points and Authorities in Support of Plaintiffs Motion to Dismiss XO Skins LLC's, Fusion of Ideas', and Ghost Armor's Inequitable Conduct Counterclaim and Affirmative Defense Pursuant to Fed. R. Civ. p. 12(b) and 9(b) Mar. 28, 2011.
U.S. District Court, District of Utah, Central Division, Case No. 2:10-cv-01257-DN "Memorandum in Opposition of Plaintiff's Motion to Dismiss XO Skins LLC's, Fusion of Ideas', and Ghost Armor's Inequitable Conduct Counterclaim and Affirmative Defense Pursuant to Fed. R. Civ. p. 12(b) and 9(b)" Apr. 28, 2011.
U.S. District Court, District of Utah, Central Division, Case No. 2:10-cv-01257-DN "United SGP Corp.'s Opposition to Plaintiff's Motion to Dismiss Inequitable Conduct Counterclaim and Affirmative Defense" Apr. 28, 2011.
U.S. District Court, District of Utah, Central Division, Case No. 2:10-cv-01257-Dn "Plaintiff's Reply in Support of its Motion to Dismiss Xo Skins LLC's, Fusion of Ideas', and Ghost Armor's Inequitable Conduct Counterclaim and Affirmative Defense Pursuant to Fed. R. Civ. P. 12(b) and 9(b)" May 16, 2011.
U.S. District Court, District of Utah, Central Division, Case No. 2:10-cv-01257-DN "Plaintiff's Reply in Support of its Motion to Dismiss SGP Corp.'s Inequitable Conduct Counterclaim and Affirmative Defense Pursuant to Fed. R. Civ. p. 12(b) and 9(b)" May 16, 2011.
U.S. District Court, District of Utah, Central Division, Case No. 2:10-cv-01257-DN "Plaintiff's Motion for Leave to File First Amended Complaint" with Proposed Order, Jul. 20, 2011.
U.S. District Court, District of Utah, Central Division, Case No. 2:10-cv-01257-DN "Memorandum of Points and Authorities in Support of Plaintiffs Motion for Leave to File First Amended Complaint" with Proposed First Amended Complaint, Jul. 20, 2011.
U.S. District Court, District of Utah, Central Division, Case No. 2:10-cv-01257-DN "Notice of Supplemental Authority Regarding Plaintiff's Motion to Dismiss Counterclaims and Affirmative Defenses" Jul. 29, 2011.
U.S. District Court, District of Utah, Central Division, Case No. 2:10-cv-01257-DN "First Amended Complaint" Sep. 6, 2011.
U.S. District Court, District of Utah, Central Division, Case No. 2:10-cv-01257-DN "Ruling" Sep. 6, 2011.
U.S. District Court, District of Utah, Central Division, Case No. 2:10-cv-01257-DN "Defendant United SGP Corp.'s Answer to First Amended Complaint and Counterclaim; Demand for Jury Trial" Sep. 23, 2011.
U.S. District Court, District of Utah, Central Division, Case No. 2:10-cv-01257-DN "Defendants XO Skins LLC, Fusion of Ideas, and Ghost Armor LLCF's Answer to First Amended Complaint" Sep. 23, 2011.
U.S. District Court, District of Utah, Central Division, Case No. 2:10-cv-01257-DN "Memorandum of Points and Authorities in Support of Plaintiff's Motion to Dismiss XO Skins LLC's, Fusion of Ideas', and Ghost Armor's Inequitable Conduct Counterclaim and Affirmative Defense Pursuant to Fed. R. Civ. P. 12(b) and 9(b)" Oct. 17, 2011.
U.S. District Court, District of Utah, Central Division, Case No. 2:10-cv-01257-DN "Memorandum of Points and Authorities in Support of Plaintiff's Motion to Dismiss SGP Corp.'s Inequitable Conduct Counterclaim and Affirmative Defense Pursuant to Fed. R. Civ. p. 12(b) and 9(b)" Oct. 17, 2011.
U.S. District Court, District of Utah, Central Division, Case No. 2:10-cv-01257-DN "Defendant Griffin Technology, Inc.'s Answer to First Amended Complaint and Counterclaim; Demand for Jury Trial" Oct. 21, 2011.

(56) References Cited

OTHER PUBLICATIONS

U.S. District Court, District Utah, Central Division, ase No. 2:10-cv-01257-DN 37 "ZAGG Intellectual Property Holding Co., Inc's Answer to Defendant Griffin Technologies, Inc's Counterclai8ms" Nov. 14, 2011.
U.S. District Court, District of Utah, Central Divsion, Case No. 2:10-cv-0127-DN "United SGP Corp's Opposition to Plaintiff's Motion to Dismiss Inequitable Conduct Counterclaim and Affirmative Defense" Nov. 17, 2011.
U.S. District Court, District of Utah, Central Dvision, Case No. 2:10-cv-01257-DN "Memorandum in Opposition of Plaintiff's Motion of Dismiss XO Skins LLC's Fusion of Ideas', and Ghost Armor's Inequitable Conduct Counterclaim and Affirmative Defenwse Pursuant to Fed. R. Civ. p. 12(b) and 9(b)" Nov. 17, 2011.
U.S. District Colurt, District of Utah, Central Division, Case No. 2:10-cv-01257-DN "Plaintiff's Reply in Support of Its Motion to Dismiss XO Skins LLC's, Fusion of Ideas', and Ghost Armor's Inequitable Conduct Counterclaim and Affirmative Defense Pursuant to Fed. r. Civ. p. 12(b) and 9(b)" Dec. 5, 2011.
U.S District Court, District of Utah, Central Divsion, Case No. 2:10-cv-01257-DN "Plaintiff's Reply in Support of its Motion to Dismiss SGP Corp's Inequitable Conduct Counterclaim and Affirmative Defense Pursuant to Fed. R. Civ. p. 12(b) and 9(b)" Dec. 5, 2011.
U.S. District Court, District of Utah, Central Division, Case No. 2:10-cv-01257-TC "Attorneys' Planning Meeting Report" Jan. 31, 2012.
U.S. District Court, District of Utah, Central Division, Case No. 2:10-cv-01257-TC "Order and Memorandum Decision" Mar. 15, 2012.
U.S. District Court, District of Utah, Central Division, Case No. 2:10-cv-01257-CW "United SGP Corp.'s Notice of Supplemental Authority Regarding Plaintiff's Motion to Dismiss Inequitable Conduct Counterclaim and Affirmative Defense" Feb. 1, 2012.
U.S. District Court, District of Utah, Central Division, Case No. 2:10-cv-01257-TC-BCW "Amended Memorandum of Points and Authorities in Support of Plaintiff's Motion to Dismiss XO Skins LLC's, Fusion of Ideas', and Ghost Armor's Inequitable Conduct Counterclaim and Affirmative Defense Pursuant to Fed. R. Civ. p. 12(b) and 9(b)" Jan. 3, 2012.
U.S. District Court, District of Utah, Central Division, Case No. 2:10-cv-01257-TC "Transcript of Feb. 14, 2012, hearing on Motions to Dismiss" Feb. 14, 2012.
"XPEL nearly doubles dealer base" San Antonio Business Journal, Jul. 7, 2005; available online at http://www.bizjournals.com/sanantonio/stories/2005/07/04/daily20.html?jst=b_ln_hl.
"XPEL hopes NASCAR relationship will rev up sales of paint-protection kits" San Antonio Business Journal, Aug. 30, 2005; available online at http://www.bizjournals.com/sanantonio/stories/2005/08/29/daily14.html?jst=b_ln_hl.
DoItYourselfTing.com "Window Tinting" www.doityourselftint.com; archived May 2005 http://web.archive.org/web/20050303000818/http://www.doityourselftint.com/ (last visited Jun. 26, 2012).
WindowTint.com Online Store; archived Mar. 2005 (last visited Jun. 26, 2012) http://web.archive.org/web/20050305015941/http://www.windowtint. com/online-store.html.
3M "Scotchcal™: Clear Graphic Film 8626 (ES)" Product Bulletin 8626, Feb. 2001.
NLU Products, LLC, "Bodyguardz scratch-proof transparent film for electronic devices," Product Literatire for Sony® PSP 2000 Series (PSP Slim) Front Only), sopyright to NLU Products, LLC 2007.
CAse No. CV 10-6511 AHM (FFMx), "Defendant NLU Products, L.L.C.'S Notice of Motion and Motion for Summary Judgement: Memorandum of Points and Authorities [Statement of Uncontroverted Facts and Conclusions of Law and Declaration of Kirk Feller Concurrently Herewith]," Filed by Defendant NLU Products, LLC , in the Unted States District Court, Central District of California, May 16, 2011.
Case No. CV 10-6511 AHM (FFMx), "Declaration of Kirk Feller in Support of Defendant NLU Products, L.L.C.'S Motion from Summary Judgement" filed Defendant NLU Products, LLC, in the United States District Court, Central District of California, May 16, 2011.
InvisibleShield "the ULTIMATE screen Protector" Website www.theinvisibles.com/application available at http://web.archive.org/web/20051022000539/http://www.theinvisibleshield.com/application/html, archived Oct. 2005 (last visited Jun. 11, 2012.
DoItYourselfTNT.com "Window Tinting" website www.doityourselftint.com available at http://web.archive.org/web/2005030300181/www.dotyourself.com/, arcived Mar. 2005.
Protective Solutions, Inc. "We Got You Covered"website www.we-got-you-covered.com/aboutfilm available at http://web.archive.org/web/20050509163117/http://www.we-got-you-covered.com/aboutfilm.html, archived May 2005 (last visited Jun. 11, 2012).
Protective Solutions, Inc. "We Got You Covered" website www.we-got-you-covered.com available at http://web.archive.org/web/20050509134536/http://www.we-got-you-covered.com/, archived May 2005 (last visited Jun. 11, 2012.
Case No. CV 10-6511 AHM (FFMx), Declaration of Melissa R. Badgett in Support of Wrapsol L.L.C.'S Rebuttal Claim Construction Brief, Filed by Defendant Wrapsol, LLC, in the United States District Court, Central District of California, Nov. 21, 2011.
"Information Disclosure Statement Transmittal," discussing Non-Patent Literature items 1-8 disclosed on "Information Disclosute Statement by Applicant" dated Jun. 12, 2013, in U.S. Appl. No. 12/856,223.
Kenton R. Osborn & Wilmer A. Jenkins, "Plastic Films: Technology and Packaging Applications," 1990, a book.

* cited by examiner

ELECTRONIC DEVICE PROTECTIVE FILM APPLICATION KIT AND METHOD

CROSS-REFERENCE TO RELATED APPLICATIONS

This application is a continuation-in-part of U.S. patent application Ser. No. 12/156,879, filed on Jun. 4, 2008, now U.S. Pat. No. 7,784,610, issued Aug. 31, 2010, which is a continuation-in-part of U.S. patent application Ser. No. 11/394,807, filed on Apr. 1, 2006, issued as U.S. Pat. No. 7,389,869 on Jun. 24, 2008.

BACKGROUND

This disclosure relates generally to protective film overlays on surfaces and more particularly to a kit and method of use for enabling the installation of such a film on an electronic device and especially its display such as used on cell phones and the like. A prior known viewing screen protective shield is removably securable in association with a viewing screen, such as LCR screens, as found in fish finders and the like, which are typically exposed to adverse weather conditions. The protective shield is readily removable and replaceable and include convex peripheral edges to conform the shield to the convex screen with an outwardly extending tab at a corner of the shield to enhance manual grasping thereof. To enhance securement of the shield to the associated screen, a plurality of transparent adhesive strips may be secured to an interior surface of the shield. It is known to provide a retrorefiective sheeting having an abrasion-resistant ceramer coating that is prepared from about 20% to about 80% ethylenically unsaturated monomers; about 10% to about 50% of acrylate functionalized colloidal silica; and about 5% to about 40% N,N-disubstituted acrylamide or N-substituted-N-vinyl-amide monomer having a molecular weight between 99 and 500 atomic mass units; wherein the percentages are weight percents of the total weight of the coating. An anti-reflective film construction is known that contains an optically transparent polymeric film having a textured surface and an optically transparent adhesive, the film construction configured to exhibit light transmission of greater than about 70 percent and a 60.degree gloss measurement of between about 15 and 100. An antiglare sheet for use with a display of a portable game machine that includes a film element serving as an antiglare film is known. An adhesive element is adapted to affix the film element to a display screen; and a ventilation opening is adapted to ventilate a space defined by the display screen and the film element. A multi-layer sheet material that comprises a film, and adhesive layer and an optional release liner is known. The film is a polyester blend comprising first and second polyesters that are substantially amorphous and possess certain physical properties including softening temperature, E-modulus, elongation and residual stress. Disclosed also is a protective diffusion film, which does not scratch a lens film and a liquid crystal display device, does not become a refuse source or the like, and also has a suitable level of concealment effect, a process for producing the same, a surface light source device, and a liquid crystal display device. This protective diffusion film is used in a surface light source device provided with a lens film wherein the protective diffusion film is provided on a light outgoing surface of the lens film, and comprises: a transparent substrate layer; and a protective diffusion layer which is provided on the transparent substrate layer in its surface at least on the lens film side, has fine concaves and convexes on its surface, protects members which come into contact with the protective diffusion film, and is light diffusive. Antisoiling hardcoated film is known in the art which comprises a substantially transparent substrate, a hardcoat layer comprising inorganic oxide particles dispersed in a binder matrix, and an antisoiling layer comprising a perfluoropolyether. The antisoiling layer can be very thin, thus reducing the cost of the perfluoropolyether. The film has very good scratch, smudge and glare resistance and very good interlayer adhesion and durability. The film can be in the form of a single flexible substrate or a stack of such substrates. The film or stack can be sized to fit the display screen of an electronic display device such as a personal digital assistant or cell phone. The art also discloses a polarized filter film having a plurality of light-filtering layers, each having a different polarization aperture and tint hue that can be selectively combined to form a polarized filter film having a combined opacity rating of 5% to 55% when applied to a transparent medium such as a window. The combined polarized filter film is comprised of a plurality of layers of light-filtering material wherein each layer has a plurality of apertures positioned either vertically or angularly so that the horizontal rays associated with glare are reduced dramatically. Each layer of film has a plurality of slotted apertures that is biased or offset from the overlaying light-filtering film apertures whereby varying degrees of light-blocking properties can be achieved by using the light-filtering films in conjunction with additional layers. The present invention is attached to the transparent medium by using an adhesive which has a removable protective backing layer. Also disclosed is a repositionable, self-adhering optical laminate having a thin film optical coating, an organic hardcoat, a thin plastic film substrate, an optical quality, pressure sensitive adhesive and, preferably, a release liner. The pressure-sensitive adhesive is a low modulus, self-wetting elastomer which readily wets glass and plastic surfaces such as video display screens, promoting bubble-free mounting. The adhesive has low tack so that bubbles can be removed easily and the laminate can be totally or partially removed and reapplied to correct its positioning and/or to remove bubbles, dirt, etc. However, the prior art fails to disclose a compact kit providing the materials and tools necessary for applying a film to a surface. The present disclosure distinguishes over the prior art providing heretofore unknown advantages as described in the following summary.

BRIEF SUMMARY

This disclosure teaches certain benefits in construction and use which give rise to the objectives described below.

The types of surfaces that the present invention is designed to protect are any of the electronic surfaces and especially the displays known in the art such as for cell phones, computers, calculators and the like. Such surfaces are subject to scratches and to the accumulation of debris such as dust and dirt of various kinds. In normal use, these displays tend to be scratched when touched, and during cleaning. Therefore, it is desirable to apply a protective sheet over such surfaces. However, devices are not commonly provided with protective layers and users are not equipped or skilled in the practice of applying such protective sheets. Therefore, the present invention is designed to provide the materials, tools and instructions for enabling a person to apply a protective layer to the surfaces of electronic devices and especially display screens. The invention is provided as a kit of materials and tools. It is preferably provided with a molded support card or other package for holding a plurality of film sheets each having an adhesive layer on one side, a spray bottle containing a cleaning and activating solution enabled for activating the adhesive layers of the film sheets, and a squeegee. The film sheets, the squeegee, and the spray bottle are secured in the package in a manner that allows them to be easily removed for applications.

A primary objective inherent in the above described apparatus and method of use is to provide advantages not taught by the prior art.

Another objective is to provide all of the items necessary to apply a protective sheet to a surface of an electronic device and its display.

A further objective is to provide such a kit that may be used at least several times.

A further objective is to provide such a kit that may have a film for dry application and alternatively, a film for wet application.

A further objective is to provide a method for applying the dry adhesive film sheet while maintaining registration between the film sheet and the receiving surface.

Other features and advantages of the present invention will become apparent from the following more detailed description, taken in conjunction with the accompanying drawings, which illustrate, by way of example, the principles of the presently described apparatus and method of its use.

DETAILED DESCRIPTION

Figure 1:
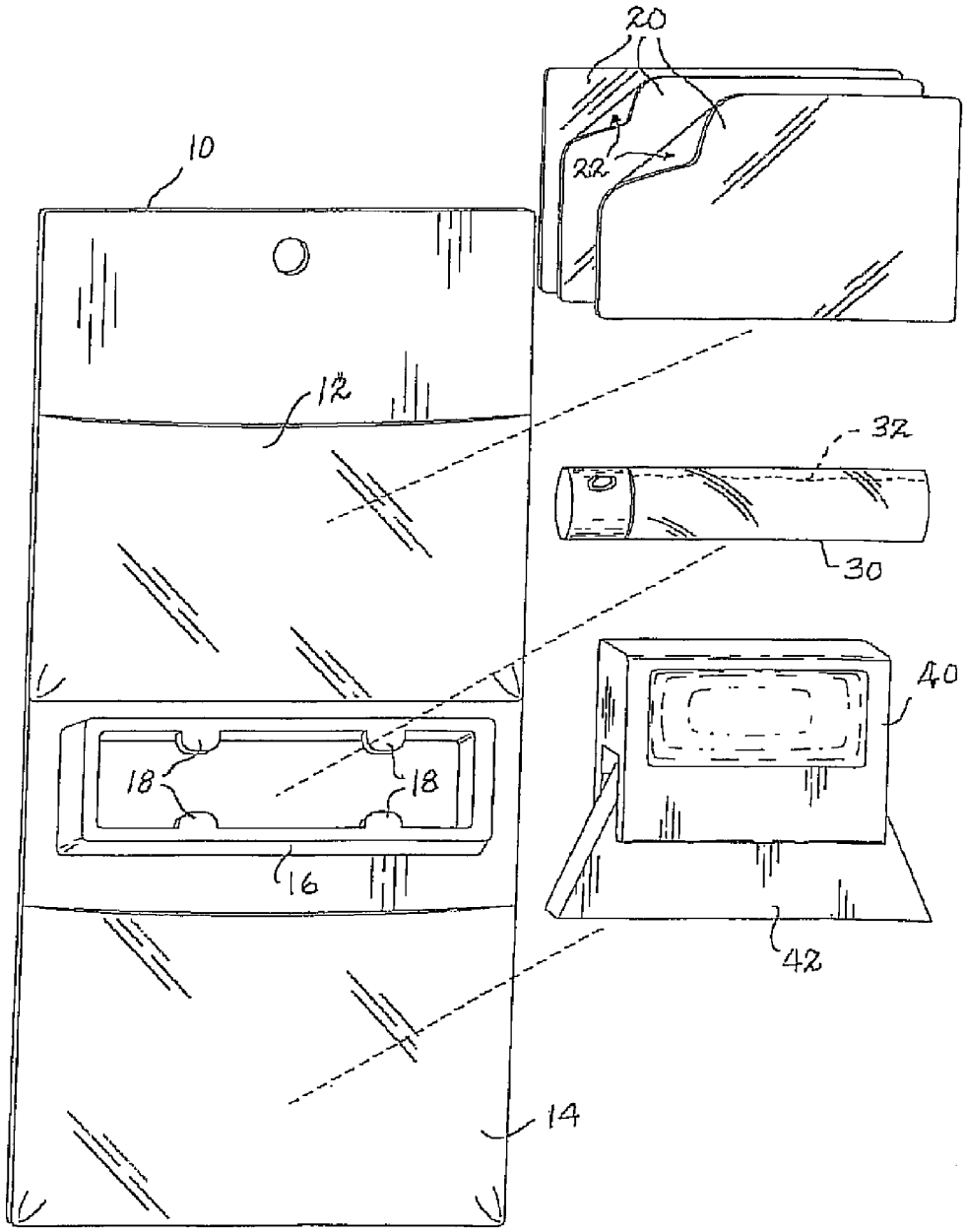
FIG. 1 is an front exploded view of an exemplary kit according to the present disclosure.

Described now in detail is a kit apparatus providing the materials and tools necessary for applying a protective film sheet 20 onto an electronic device 4 and especially a display 5 thereof. The term "display 5" herein shall mean any surface of the device 4 including a display or other surface. The kit apparatus, as shown in FIG. 1, may include a package 10 that may be a molded support card, a folded paper box or any similar container made of plastic, paper, cardboard or other materials. The package 10, in one embodiment, provides two pockets 12 and 14 and a molded recess 16. However, the package may be structured in alternative ways with more or less recesses, pockets and/or other means for securing the materials and tools. The term "pocket 12" is used herein to mean any feature of the package that may be used for securing the materials and tools.

Figure 2:
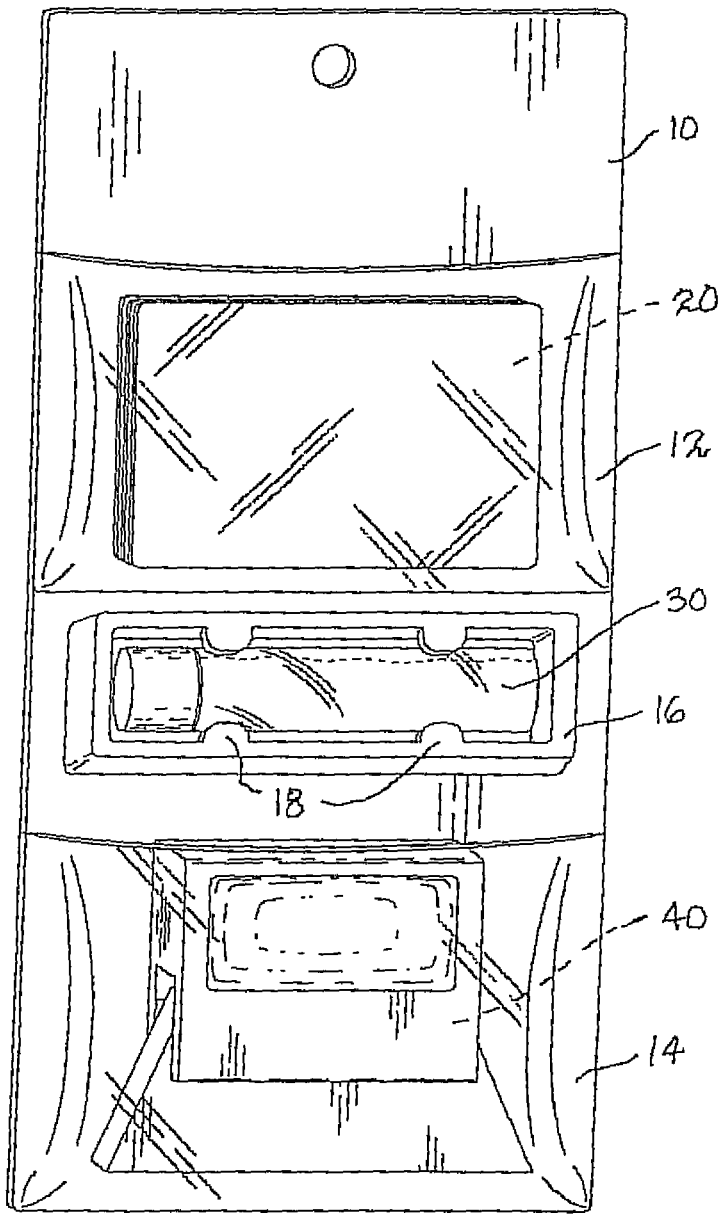
FIG. 2 is an front elevational view of the exemplary kit of FIG. 1 as assembled.
Figure 3:
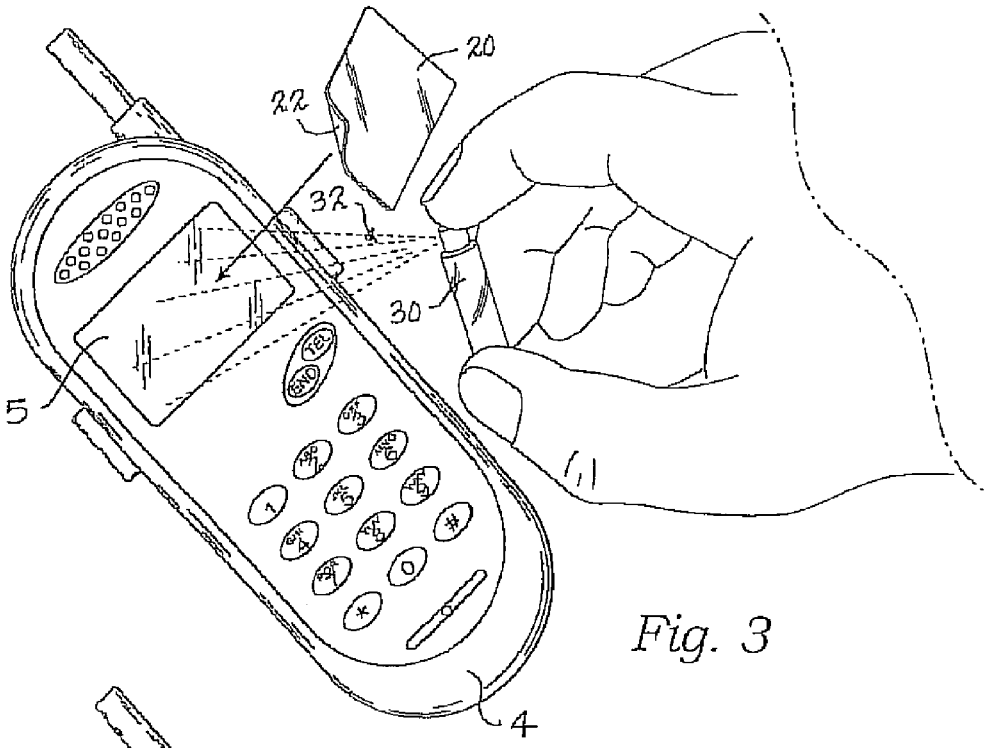
FIG. 3 is a perspective view showing a surface preparation step according to the present disclosure.

At least one, but preferably, a plurality of film sheets 20 may be secured within a first one of the pockets 12 as shown in FIG. 2. These sheets 20 are preferably cut to the exact size of the electronic display screen 5 or other surface that they are to be mounted onto so that no cutting and minimal fitting steps are necessary in accomplishing the objective of the kit; to provide a protective cover on the device 4. The sheets 20 are preferably made of an optically clear film of a hard and scratch resistant type such as polyurethane, polyethylene or polycarbonate and are preferably between 0.5 and 20.0 thousandths of an inch in thickness, wherein such a thickness range provides the required flexibility in its thinner gauges and extreme durability in its heavier gauges. A film thickness below 0.5 thousandths of an inch is subject to tearing and is difficult to handle, while a film thickness greater than 20.0 thousandths of an inch tends to be excessively rigid for the present application so that it tends to lift from the surface it is secured to due to thermal expansion differences between film and application surface. The sheets 20 are coated on one side with an adhesive 22. In one embodiment the adhesive 22 may be of the type that is activated by a solution 32 such as alcohol or water, and as shown in FIG. 3 the solution 32 is applied to the screen 5 for cleaning it as an initial preparation step, and after drying the now clean surface, the solution 32 is applied a second time just prior to placement of sheet 20. In an alternate embodiment, the adhesive 22 may also be designed for dry attachment in which case no solution 32 is required. In this case, an alcohol wipe or similar cleaning article may be used to clean and prepare the screen 5 for receiving the dry adhesive 22. In both embodiments, wet and dry, a peel-away cover sheet 25 is required to cover the adhesive 22 prior to applying the sheet 20 to the screen 5.

When solution 32 is used, a miniature bottle 30 containing the solution 32 may be secured within the molded recess 16. The miniature bottle 30 may be a manually operated spray bottle, but may alternately be another kind of bottle. The solution 32 is preferably a substance that is environmentally friendly, is a good degreasing agent and is capable of partially dissolving the adhesive 22, i.e., for activation.

A miniature squeegee 40 is secured within a second one of the pockets 14. Such a squeegee 40 is small and preferably has a blade 42 with a contact edge of a length not greater than the largest dimension of the film sheet 20. This is necessary in case the display screen 5 is recessed since it is necessary for the squeegee 40 to be drawn across all parts of the sheet 20 to drain the solution 32 and air trapped under sheet 20 after its attachment to screen 5.

Figure 5:
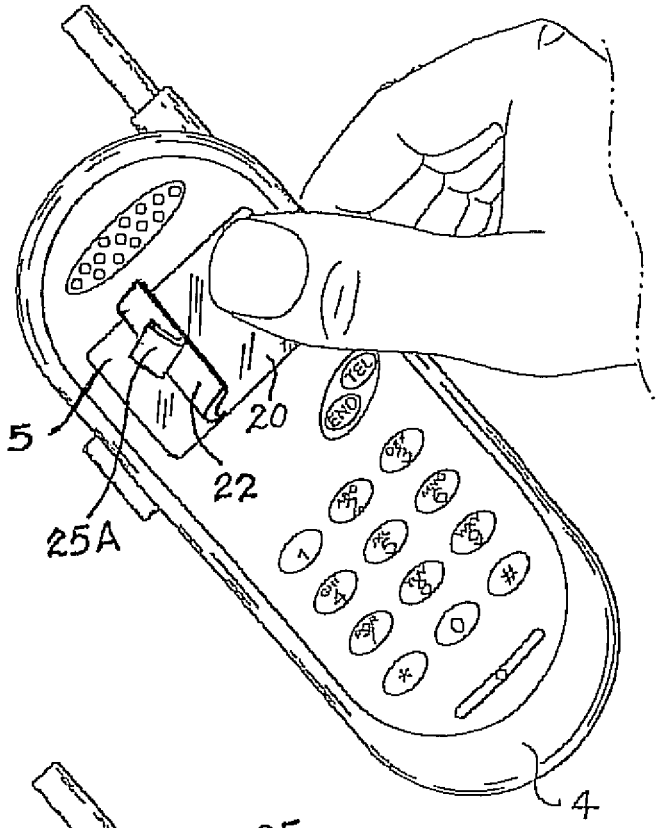
FIG. 5 is a perspective view as in FIG. 3, showing a first step for attaching a protective cover with a dry adhesive according to the present disclosure.
Figure 6:
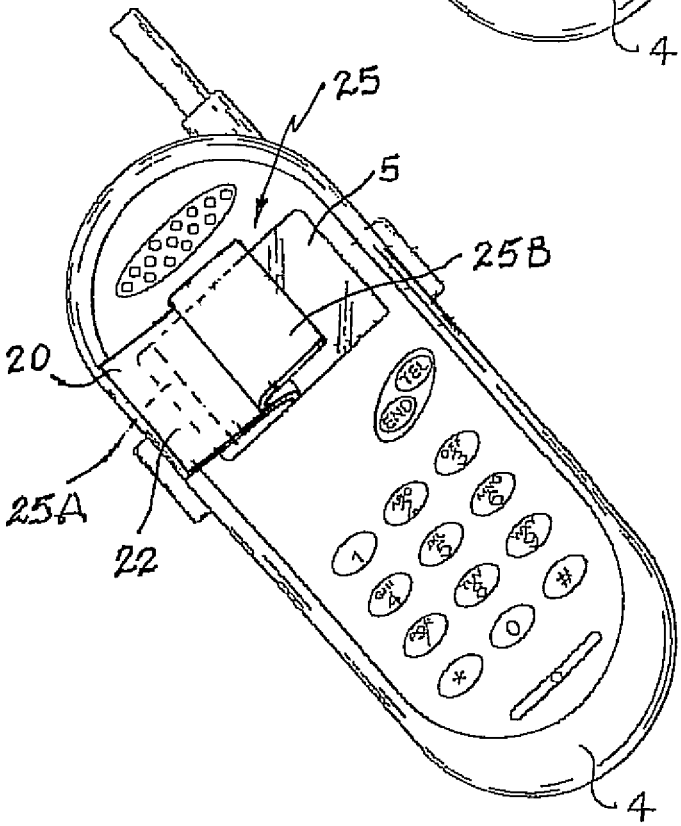
FIG. 6 is a perspective view as in FIG. 3, showing a second step for attaching the protective cover with a dry adhesive according to the present disclosure.

As stated above, sheet 20 has a layer of adhesive 22 on one side thereof. As also stated, the adhesive 22 is covered with a peel-away cover sheet 25. Sheet 25 may be a single integral sheet of plastic or paper that fully covers the adhesive 22. Referring to FIGS. 5 and 6, In a preferred embodiment for dry attachment of sheet 20 to screen 5, sheet 25 has a first portion 25A and a second portion 25B where both portions are part of the single sheet 25, but are separated by a perforation that allows one of the portions, for instance portion 25A, to be peeled away from adhesive 22 without disturbing the remaining portion 25B.

Figure 4:
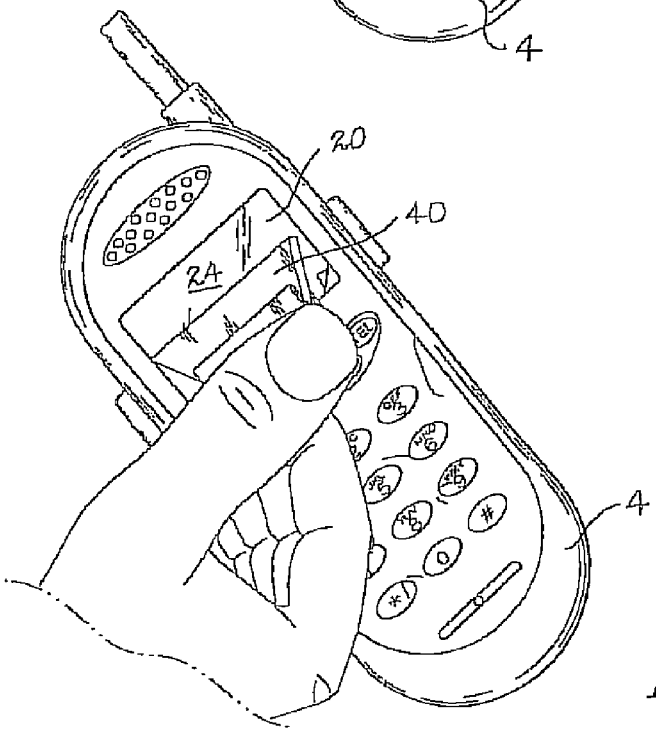
FIG. 4 is a perspective view as in FIG. 3, showing a finishing step according to the present disclosure.

Described now in detail is a method for the installation of the film sheet 20 onto electronic screen 5. At least one film sheet 20 is provided. For wet application, the bottle 30 containing the cleaning and activating solution 32 and a squeegee 40 are provided in the kit. The cleaning and activating solution 32 is sprayed or otherwise deposited onto screen 5 and is then removed with the squeegee 40 or with an absorbent cloth, etc. This step removes dust, dirt or grease from the screen 5. Next, the cleaning and activating solution 32 is deposited onto the screen 5 again and the film sheet 20, after peeling away the cover sheet 22, is placed onto screen 5 with the adhesive layer 22 in contact with the solution 32 on screen 5 as shown in FIG. 3. The film sheet 20 is moved if necessary to position it on screen 5 to assure mutual registration and alignment, and, while holding the film 20 in place manually the solution 32 is pressed out from between the sheet 20 and screen 5 using the squeegee 40 as shown in FIG. 4.

Described now in detail is a method for the installation of the film sheet 20 for dry applications. When a liquid cannot be used, the kit does not include bottle 30 or activating solution 32. However, squeegee 40 is still provided in the kit. Dust, dirt or grease may be removed from the application surface using a moist wipe such as an alcohol impregnated wiper and such a wiper (not shown) may be included within the kit. Next, the film sheet 20, with its peel-away cover sheet 25 is placed onto screen 5 and carefully moved thereon to position it in full registration with screen 5. Next, in a preferred step, when cover sheet 25 is perforated into portion 25A and 25B, with the sheet 20 pinned in place by manual pressure as shown in FIG. 5, one edge of the sheet 20 is lifted away from the screen 5 and portion 25A of cover sheet 25 is peeled off adhesive layer 22. The one edge of sheet 20, with its adhesive surface exposed, is then pressed into contact with screen 5 which securely establishes and fixes the registration between sheet 20 and screen 5. Next, as shown in FIG. 6, the portion 25B is lifted fully away from screen 5, and without detaching the adhered edge of sheet 20, the portion 25B of cover sheet 25 is peeled away from adhesive 22. Finally, the remaining part of sheet 20 is pressed into contact with screen 5, and squeegee 40 is used to assure intimate contact between sheet 20 and screen 5, and also to assure that any air bubbles are pressed out, as shown in FIG. 4.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A kit for protecting a surface of an electronic device, comprising:

a film sheet cut to a specific size and shape corresponding to a size and shape of a surface of an electronic device the film sheet is configured to protect;

an adhesive layer on one side of the film sheet;

a peel-away cover film impermanently secured to the adhesive layer;

an application element for removing air bubbles between the film sheet and a surface of an electronic device as the film sheet is applied to the electronic device; and a package containing the film sheet and the application element.

2. The kit of claim 1, wherein the peel-away cover film includes two portions and perforations defining a boundary between the two portions, each portion of the two portions being configured to be peeled away from the adhesive layer without disturbing another portion of the two portions.

3. The kit of claim 1, further comprising:

a liquid solution.

4. The kit of claim 3, further comprising:

the package further containing the liquid solution.

5. The kit of claim 1, wherein the application element has a contact edge length smaller than a largest linear dimension of the surface of the electronic device.

6. The kit of claim 1, wherein the film sheet has a thickness of 0.5 thousandths of an inch to 20 thousandths of an inch.

7. The kit of claim 1, comprising a plurality of film sheets.

8. A combination electronic device and a kit for protecting a surface of the electronic device, the combination comprising:

an electronic device with a surface having a specific size and shape; and a kit, including:

a film sheet cut to a specific size and shape that corresponds to the specific size and shape of the surface of the electronic device;

an adhesive layer on one side of the film sheet;

a peel-away cover film impermanently secured to the adhesive layer;

an application element for removing air bubbles between the film sheet and a surface of an electronic device as the film sheet is applied to the electronic device; and a package carrying the application element and the film sheet with the adhesive layer and the peel-away cover film.

9. The combination of claim 8, wherein the peel-away cover film includes two portions and perforations defining a boundary between the two portions, each portion of the two portions being configured to be peeled away from the adhesive layer without disturbing another portion of the two portions.

10. The combination of claim 8, wherein the kit further includes:

a liquid solution.

11. The combination of claim 10, wherein the:

package also carries the liquid solution.

12. The combination of claim 8, wherein the application element has a contact edge length smaller than a largest linear dimension of the surface of the electronic device.

13. The combination of claim 8, wherein the film sheet has a thickness of 0.5 thousandths of an inch to 20.0 thousandths of an inch.

14. The combination of claim 8, comprising a plurality of film sheets.

15. A method for protecting a screen of an electronic device, comprising:

removing from a package a film sheet cut to a specific size and shape corresponding to a size and shape of the screen of the electronic device the film sheet is configured to protect and an application device;

placing the film sheet into contact with the screen with a cover sheet between the film sheet and the screen;

moving the film sheet to achieve registration between the film sheet and the screen;

pinning the film sheet to the screen;

peeling a first portion of the cover sheet away from the film sheet to expose an adhesive;

pressing the adhesive to the screen to adhere part of the film sheet to the screen and to fix registration between the film sheet and the screen;

with a portion of the film sheet adhesively secured to the screen, lifting a non-adhered part of the film sheet away from the screen while peeling away a remainder of the cover sheet to expose a remainder of the adhesive; and pressing the adhesive of the non-adhered part of the film sheet to the screen.

16. The method of claim 15, further comprising:

pressing an application element into contact with the screen in a manner to assure intimate contact between the film sheet and the screen and to eliminate air bubbles between the film sheet and the screen.

17. The method of claim 15, further comprising:

while pinning the film sheet to the screen, lifting one edge of the film sheet away from the screen.

18. The method of claim 17, wherein pinning the film sheet to the screen comprises applying manual pressure to hold the film sheet in place on the screen.

* * * * *

UNITED STATES PATENT AND TRADEMARK OFFICE

CERTIFICATE OF CORRECTION

PATENT NO. : 8,567,596 B1
APPLICATION NO. : 12/856223
DATED : October 29, 2013
INVENTOR(S) : Mason, Jr.

It is certified that error appears in the above-identified patent and that said Letters Patent is hereby corrected as shown below:

Title Page:

Item (73), delete the Assignee information and substitute the following:

--ZAGG Intellectual Property Holding Co., Inc., Salt Lake City, UT (US)--

In the Specification:

BACKGROUND:

Column 1, Line 25, change “include” to --includes--

Column 1, Line 43, change “60.degree” to --60 degree--

Column 1, Line 50, change the first occurrence of “and” to --an--

Column 1, Line 56, change “and” to --or--

Column 1, Line 61, add a --,-- after “film”

BRIEF SUMMARY

Column 3, Line 14, add a --,-- after “and”

DESCRIPTION OF DRAWINGS

Column 3, Line 27, change the first occurrence of “an” to --a--

Column 3, Line 29, change “an” to --a--

Column 3, Line 40, change “disclosure, and” to --disclosure.--

DETAILED DESCRIPTION

Column 3, Line 46, change “display” to --screen--

Column 3, Line 47, change ““display 5”” to --screen--

Column 3, Line 55, change “less” to --fewer--

Column 3, Line 56, change “pocket 12” to --pocket--

Column 3, Line 61, insert --film-- after “These”

Signed and Sealed this
Twentieth Day of May, 2014

Michelle K. Lee

Michelle K. Lee
*Deputy Director of the United States Patent and Trademark Office*

Column 3, Line 64, change “kit;” to --kit:--

Column 3, Line 65, insert --film-- after “The”

Column 4, Line 10, change “surface.” to --surfaces.--

Column 4, Line 10, insert --film-- after “The”

Column 4, Line 11, add a --,-- after “embodiment”

Column 4, Line 12, add a --,-- after “32”

Column 4, Line 13, add a --,-- after “and”

Column 4, Line 13, add a --,-- after “FIG. 3”

Column 4, Line 14, delete the “,” after “step”

Column 4, Line 16, insert --film-- after “of”

Column 4, Line 24, insert --film-- after the first occurrence of “the”

Column 4, Line 25, delete “miniature”

Column 4, Line 27, delete “miniature”

Column 4, Line 36, delete “display”

Column 4, Line 37, insert --film-- after the second occurrence of “the”

Column 4, Line 38, insert --film-- after “under”

Column 4, Line 40, insert --film-- after “above,”

Column 4, Line 45, insert --film-- after “of”

Column 4, Line 48, add a --,-- after “instance”

Column 4, Line 52, delete “electronic”

Column 4, Line 54, delete “cleaning and activating”

Column 4, Line 55, delete “cleaning and activating”

Column 4, Line 59, delete “cleaning and activating”

Column 4, Line 61, change “cover sheet 22” to --cover sheet 25--

Column 4, Line 62, delete “layer”

Column 4, Line 65, insert --sheet-- after “the”

Column 4, Line 66, insert --film-- after the second occurrence of “the”

Column 5, Line 6, add a --,-- after “wiper”

Column 5, Line 12, insert --film-- after “the”

Column 5, Line 13, insert --film-- after the first occurrence of “the”

Column 5, Line 15, insert --film-- after “of”

Column 5, Line 15, delete “surface”

Column 5, Line 17, insert --film-- after “between”

Column 5, Line 20, insert --film-- after the first occurrence of “of”

Column 5, Line 22, insert --film-- before “sheet 20”

Column 5, Line 23, insert --film-- after “between”

(12) INTER PARTES REVIEW CERTIFICATE (986th)

United States Patent
Mason, Jr.

(10) Number: US 8,567,596 K1
(45) Certificate Issued: Mar. 23, 2018

(54) ELECTRONIC DEVICE PROTECTIVE FILM APPLICATION KIT AND METHOD

(75) Inventor: Andrew C. Mason, Jr.

(73) Assignee: ZAGG INTELLECTUAL PROPERTY HOLDING CO., INC.

Trial Number:

IPR2014-01262 filed Aug. 8, 2014

Inter Partes Review Certificate for:

Patent No.: 8,567,596
Issued: Oct. 29, 2013
Appl. No.: 12/856,223
Filed: Aug. 13, 2010

The results of IPR2014-01262 are reflected in this inter partes review certificate under 35 U.S.C. 318(b).

INTER PARTES REVIEW CERTIFICATE
U.S. Patent 8,567,596 K1
Trial No. IPR2014-01262
Certificate Issued Mar. 23, 2018

AS A RESULT OF THE INTER PARTES REVIEW PROCEEDING, IT HAS BEEN DETERMINED THAT:

Claims 1-18 are cancelled.

* * * * *